US010458170B2

(12) United States Patent
Vesca

(10) Patent No.: US 10,458,170 B2
(45) Date of Patent: Oct. 29, 2019

(54) ANTI-FALL SAFETY SYSTEM FOR WINGS, DOORS, MAIN DOORS, UP-AND-OVER DOORS, WINDOWS, VASISTAS WINDOWS

(71) Applicant: SERRAMETAL S.R.L., Mortegliano (UD) (IT)

(72) Inventor: Giuseppe Vesca, Mortegliano (IT)

(73) Assignee: SERRAMETAL S.R.L., Mortegliano (UD) (IT)

( * ) Notice: Subject to any disclaimer, the term of this patent is extended or adjusted under 35 U.S.C. 154(b) by 0 days.

(21) Appl. No.: 15/323,848

(22) PCT Filed: May 27, 2015

(86) PCT No.: PCT/EP2015/001081

§ 371 (c)(1),
(2) Date: Jan. 4, 2017

(87) PCT Pub. No.: WO2016/188544

PCT Pub. Date: Dec. 1, 2016

(65) Prior Publication Data

US 2017/0159342 A1 Jun. 8, 2017

(51) Int. Cl.
*E05F 7/06* (2006.01)
*E05D 15/526* (2006.01)

(52) U.S. Cl.
CPC ..... *E05F 7/06* (2013.01); *E05D 15/526* (2013.01); *E05Y 2201/654* (2013.01); *E05Y 2800/252* (2013.01); *E05Y 2900/132* (2013.01); *E05Y 2900/148* (2013.01)

(58) Field of Classification Search
CPC ..... E05F 7/06; E05C 19/00; E05D 15/526
See application file for complete search history.

(56) References Cited

U.S. PATENT DOCUMENTS 5,009,034 A * 4/1991 Schneider ..... E05D 15/5211 49/192
5,297,315 A * 3/1994 Yulkowski ..... E05D 1/04 16/248

FOREIGN PATENT DOCUMENTS

DE 20213559 U1 1/2004
DE 202008011516 U1 * 12/2009 ..... E05D 15/526
DE 202008011516 U1 12/2009
DE 202013009352 U1 * 11/2013 ..... E05D 15/526
(Continued)

OTHER PUBLICATIONS

International Search Report for corresponding International Application No. PCT/EP2015/001081.

*Primary Examiner* — Catherine A Kelly
(74) *Attorney, Agent, or Firm* — Egbert, McDaniel & Swartz, PLLC

(57) ABSTRACT

Anti-fall safety system intended to prevent the detachment of a first component with respect to a second component of an opening and closing system, wherein the first component and the second component are constrained to each other by a reciprocal retainer, in such a way that the first component is mobile with respect to the second component, the safety system having an at least partially flexible elongated means which is provided with at least one engagement element placed in correspondence of one end of the elongated means, the engagement element being intended to engage in correspondence of an engagement point, following the engagement the elongated means preventing the detachment of the first component with respect to the second component.

20 Claims, 7 Drawing Sheets

(56) References Cited

FOREIGN PATENT DOCUMENTS

| | | | | |
|---|---|---|---|---|
| EP | 1837472 A1 * | 9/2007 | ..... | E05D 7/005 |
| EP | 3043013 B1 * | 7/2017 | ..... | E05D 15/5211 |

* cited by examiner

ANTI-FALL SAFETY SYSTEM FOR WINGS, DOORS, MAIN DOORS, UP-AND-OVER DOORS, WINDOWS, VASISTAS WINDOWS

TECHNICAL FIELD

The present invention relates to an anti-fall safety system for casings, wings, doors, main doors, up-and-over doors, windows, vasistas windows, gates according to the characteristics of the pre-characterizing part of claim 1.

The present invention also relates to an opening and closing system according to the characteristics of the pre-characterizing part of claim 17.

The present invention also relates to a frame according to the characteristics of the pre-characterizing part of claim 19.

DEFINITIONS

In the present description and in the appended claims the following terms must be understood according to the definitions given in the following.

By the term "frame" one means the ensemble of a casing and of a door applied on the casing itself, by "casing" meaning the fixed structure of the frame which is applied in an opening of a building and which is intended for the assembly of a door which is mobile with respect to the casing for opening and closing the opening of the building, by "door" meaning the mobile part of the frame which is mobile with respect to the casing according to directions of opening that may be, as an example only and without limits for the purposes of the present invention, transverse directions of opening and closing as in the case of sliding doors, inclined directions of opening and closing as in the case of bottom-hinged frames, directions of opening and closing with rotation of the door with respect to a side or intermediate hinging line as in the case of access doors, windows, skylights, etc., or combinations of the above-mentioned opening movements as in the case of doors which can be selectively opened by sliding or by means of bottom-hinged opening or in the case of doors which can be selectively opened by rotation on side hinging or by means of bottom-hinged opening.

By the term "door" one means the mobile part of the frame which can assume different shapes, such as, as an example only and without limits for the purposes of the present invention, access doors and windows.

By the term "framework" one means the ensemble of the four perimeter elements that are reciprocally fixed after each other to form a perimeter structure that is generally quadrangular, but that can also have other shapes, such as triangular, trapezoidal, circular, elliptic shapes, which are going to be included within the present invention. The term framework can be indifferently referred to the perimeter structure of the casing and of the door.

Prior Art

In the field of production of frames, both the casing or fixed framework of the frame and the door or mobile framework are usually made up of perimeter elements, in general four elongated perimeter elements making up two uprights and two cross members. The perimeter elements are reciprocally fixed after each other to form a perimeter structure, which is generally quadrangular. The door is applied to the casing in such a way as to enable the opening of the door itself according to different opening modes and according to opening directions that may be, as an example only and without limits for the purposes of the present invention, transverse directions of opening and closing as in the case of sliding doors, inclined directions of opening and closing as in the case of bottom-hinged frames, directions of opening and closing with rotation of the door with respect to a side or intermediate hinging line as in the cases of access doors, windows, skylights, etc., or combinations of the above-mentioned opening movements as in the case of doors which can be selectively opened by sliding or by means of bottom-hinged opening or in the case of doors which can be selectively opened by rotation on side hinging or by means of bottom-hinged opening. The fixing of the door to the casing is generally carried out by means of hinges, hinged brackets, guides, etc.

Similar fixing systems are applied in the case of wings, doors, main doors, up-and-over doors, windows, vasistas windows, gates.

Patent application DE 20 2008 011516 describes an access door or a window in which the wing, which is rotatable with respect to a framework, is provided with at least one safety element, wherein the safety element, during the normal operation of the door or of the window does not perform any function in such a way as to enable the operation of the wing with respect to the frame while, when the wing is in a position other than those provided in the normal operation, the safety element prevents the wing from falling, wherein the safety element is a traction-resistant cable provided at its ends with a thickening whose size is greater than a through-hole of a mounting plate.

Patent application DE 20 213559 describes a hardware element for windows, doors or the like placed between the frame and the wings which allows the rotation or inclination of the wing with respect to the frame, said hardware element being a flexible element which enables the free operation of the wing in the normal conditions of use and that out of the allowable nominal positions of the wing with respect to the frame prevents the wing from falling being an anti-breaking safety element.

Problems of the Prior Art

The solutions of fixing of the door to the casing of the prior art can be subjected to detachments with the consequence that the door can fall down from the casing and cause serious injuries to the people nearby. The detachment can occur for example due to a wrong use of the opening mechanisms by the user, due to the wear of the components, due to the wrong assembly of the fixing mechanisms, due to unexpected stresses or according to stress directions that normally do not occur.

Similar considerations are also valid in the case of wings, doors, main doors, up-and-over doors, windows, vasistas windows, gates.

Aim of the Invention

The aim of the present invention is to provide a system that in case of detachment of the door from the casing allows to prevent the door from falling or anyway to limit the damage that it may cause by falling.

Concept of the Invention

The aim is achieved by the characteristics of the main claim. The sub-claims represent advantageous solutions.

Advantageous Effects of the Invention

The solution according to the present invention, by the considerable creative contribution the effect of which constitutes an immediate and important technical progress, has various advantages.

The solution advantageously allows to prevent the door from falling or anyway to limit the damage that it may cause by falling in the case in which the door detaches from the casing on which it is mounted.

Advantageously the solution according to the present invention also allows to damp the falling energy.

DESCRIPTION OF THE DRAWINGS

In the following a solution is described with reference to the enclosed drawings, which are to be considered as a non-exhaustive example of the present invention in which.

DESCRIPTION OF THE INVENTION

Figure 1:
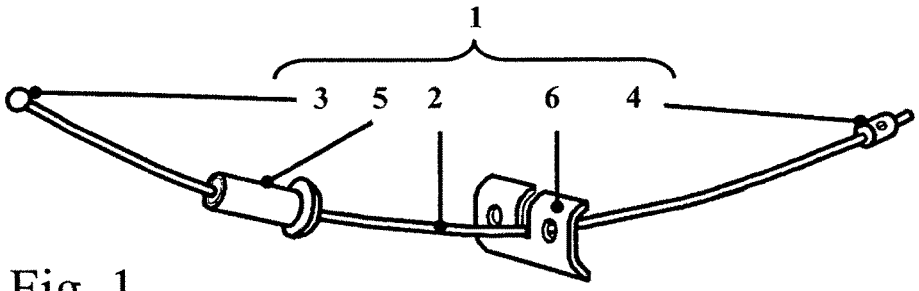
FIG. 1 schematically shows a perspective view of the anti-fall safety system made in accordance with the present invention.
Figure 2:
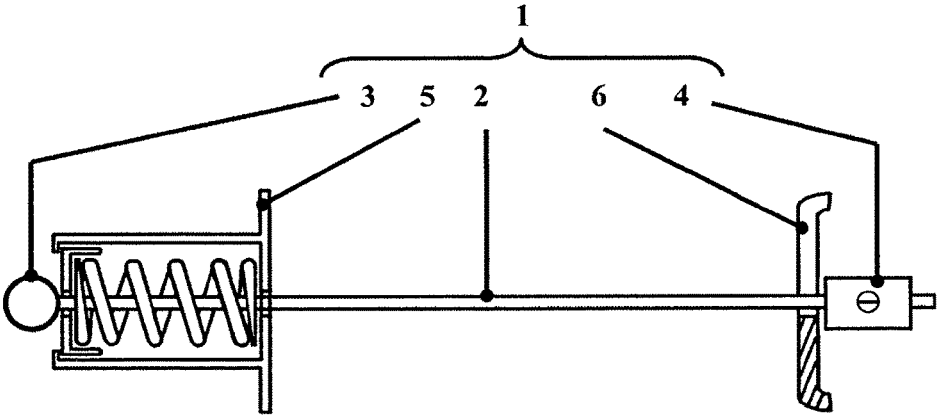
FIG. 2 schematically shows a side view partially in section of the anti-fall safety system made in accordance with the present invention in a first condition.
Figure 3:
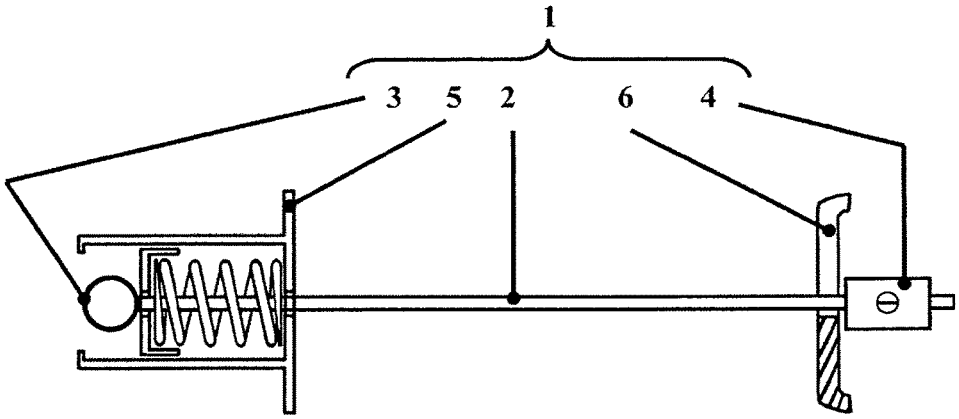
FIG. 3 schematically shows a side view partially in section of the anti-fall safety system made in accordance with the present invention in a second condition.
Figure 4:
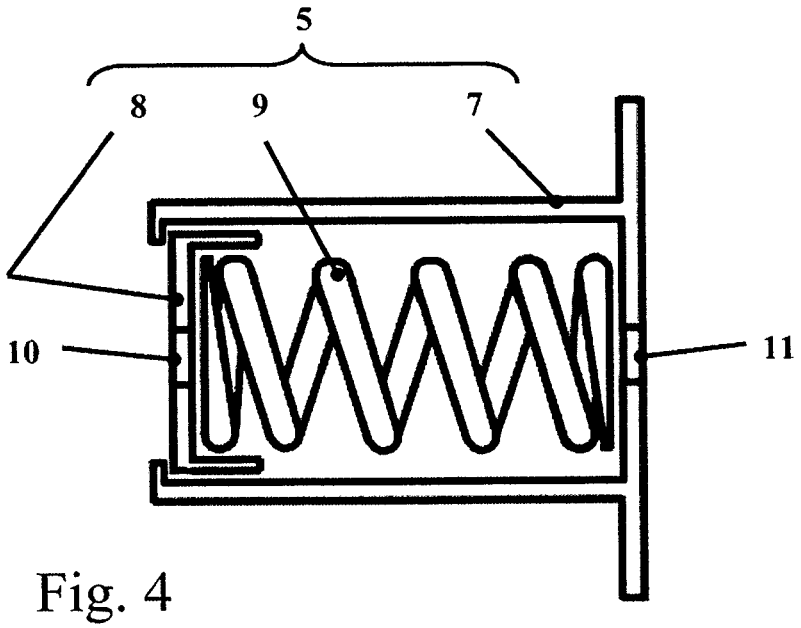
FIG. 4 schematically shows a side view partially in section of one of the components of the anti-fall safety system made in accordance with the present invention.
Figure 5:
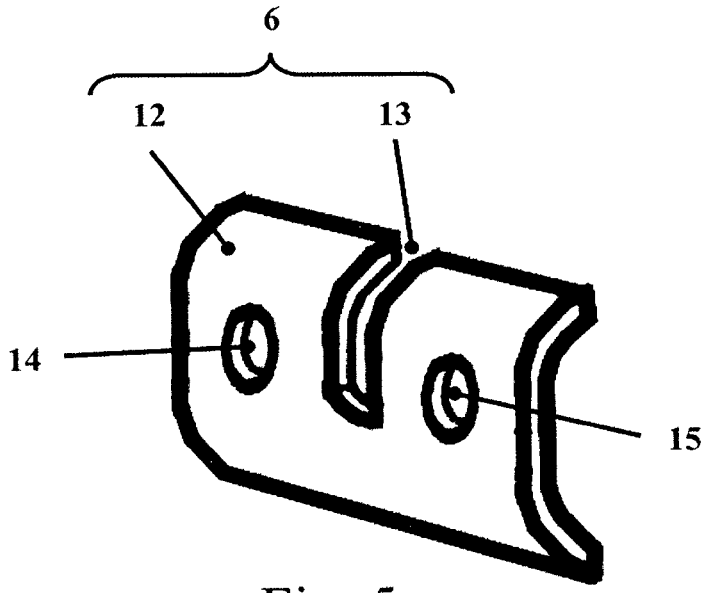
FIG. 5 schematically shows a perspective view of another one of the components of the anti-fall safety system made in accordance with the present invention.
Figure 6:
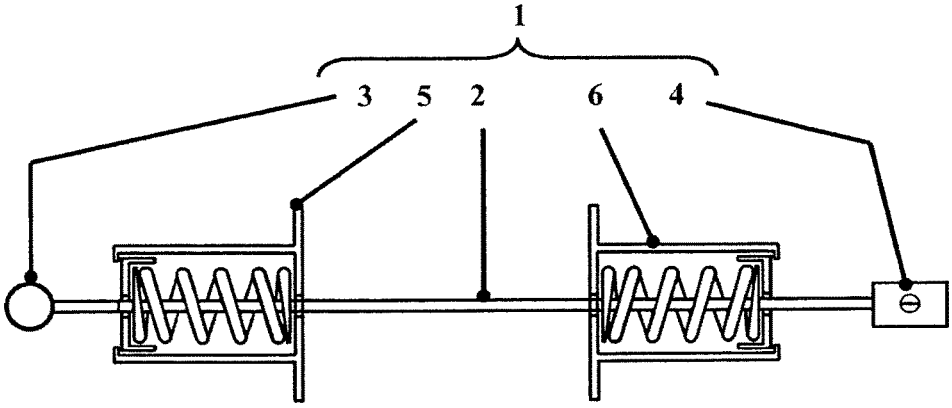
FIG. 6 schematically shows a side view partially in section of a second embodiment of the anti-fall safety system made in accordance with the present invention.

With reference to the Figures (FIG. 1, FIG. 6, FIG. 9, FIG. 10) the anti-fall safety system (1) according to the present invention allows to prevent a mobile part, such as the door (18) of a frame (16) from falling with respect to the fixed part or fixed framework (17) of the frame (16) in the case in which there is a failure, breaking or detachment of the retaining means such as the hinges (19) which enable the rotation of the door (18). In fact, as it will be explained in the following of the present description, the application of the safety system (1) to the frame (16) allows to normally use the frame in a traditional way and without the use of the frame being hindered or affected by the presence of the safety system (1) itself but, in case of breaking or detachment of one or more hinges (19), the anti-fall safety system (1) according to the present invention intervenes preventing the door (18) from falling onto the user who operates the door or the opening mechanisms of the latter or, better, preventing the displacement beyond a pre-set maximum safety limit.

Figure 7:
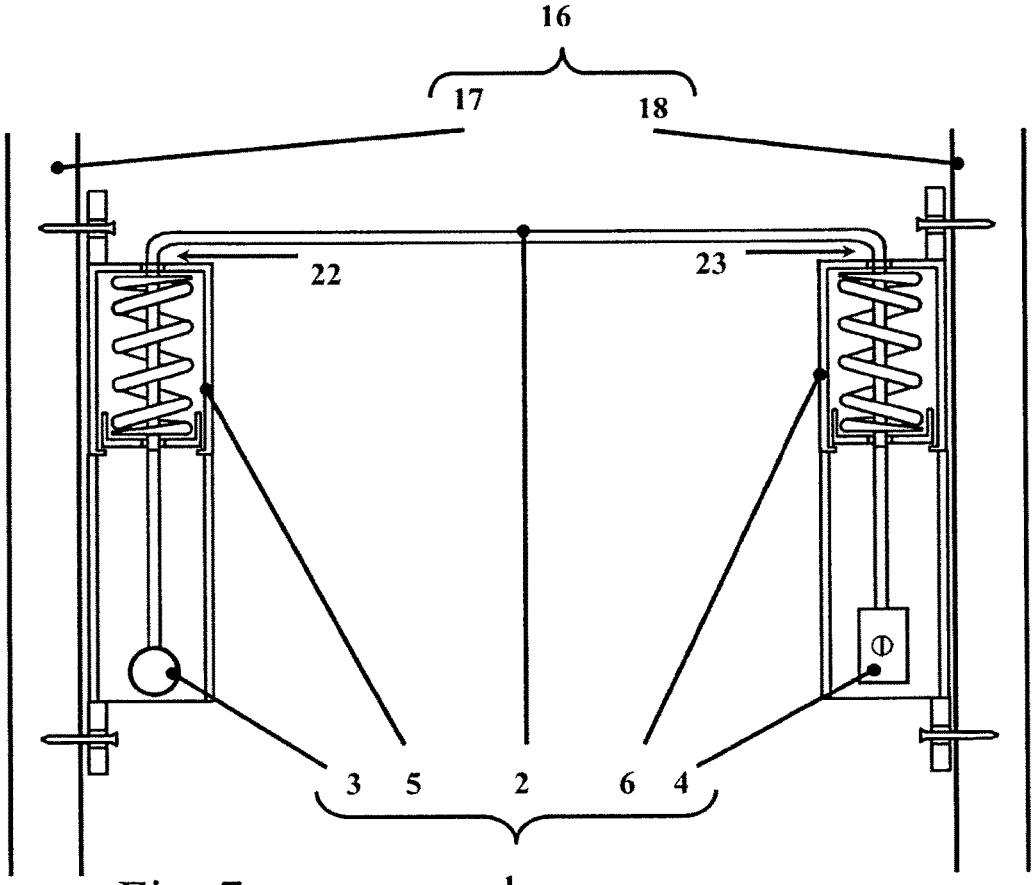
FIG. 7 schematically shows a side view partially in section of a third embodiment of the anti-fall safety system made in accordance with the present invention.
Figure 8:
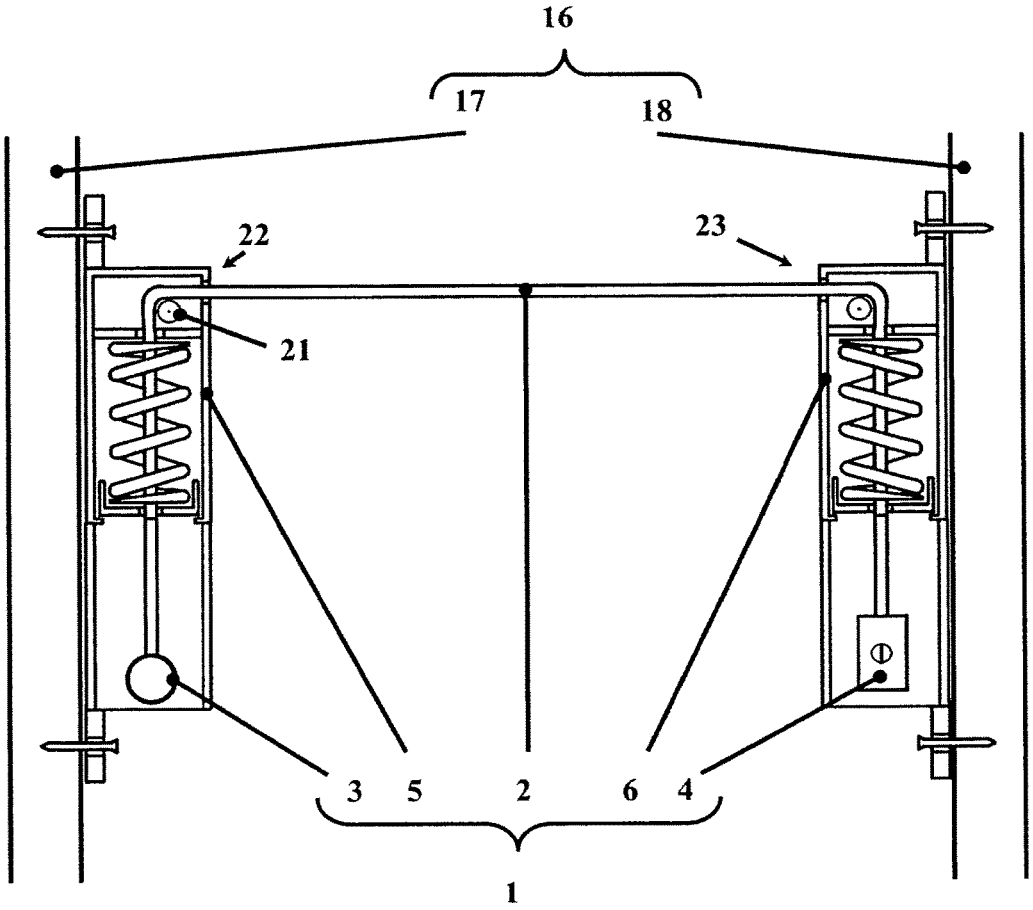
FIG. 8 schematically shows a side view partially in section of a fourth embodiment of the anti-fall safety system made in accordance with the present invention.

The safety system (1) according to the present invention can be applied in many contexts, such as casings (FIG. 7, FIG. 8, FIG. 9), wings, doors, main doors, up-and-over doors, windows, vasistas windows (FIG. 10), gates (FIG. 11), etc.

Figure 9:
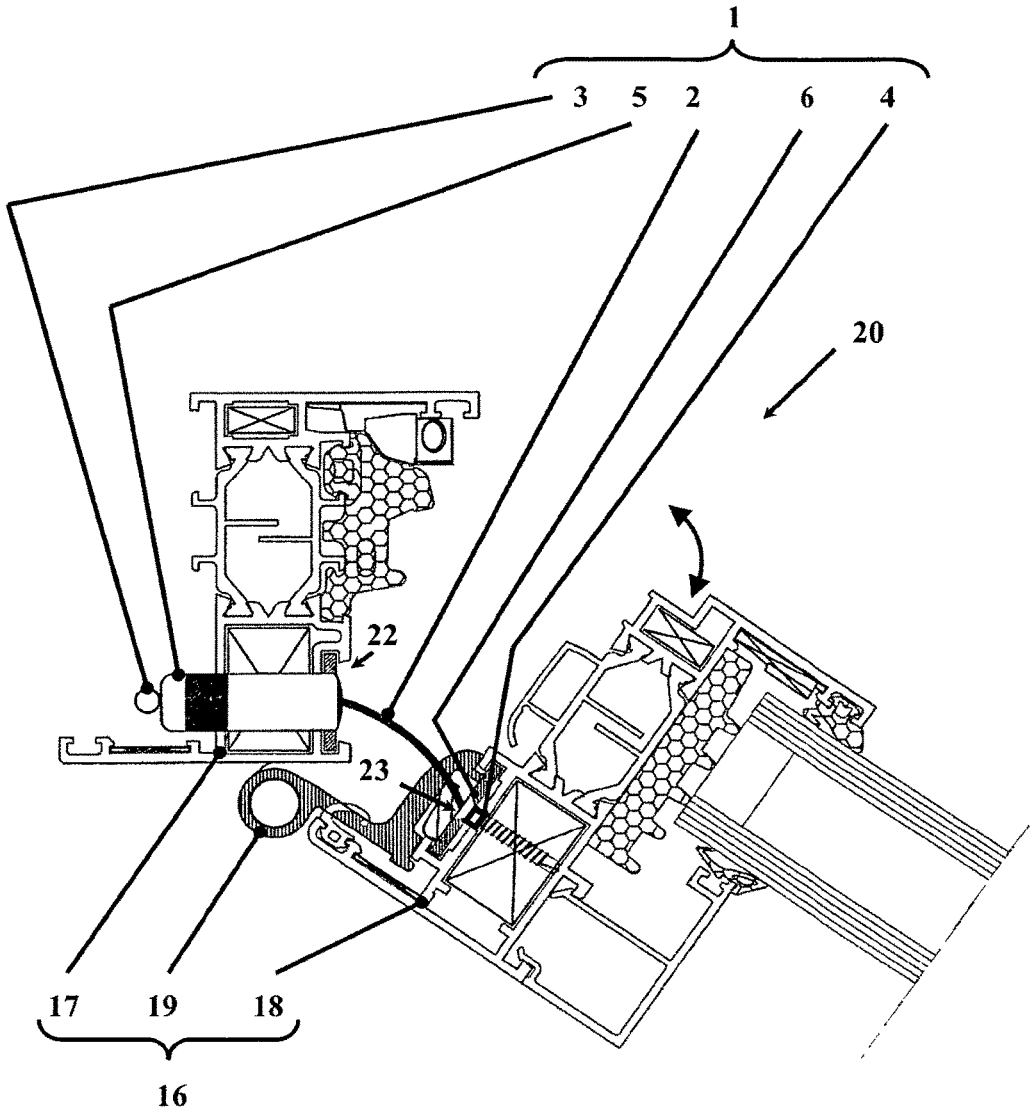
FIG. 9 schematically shows a plan view partially in section depicting the assembly of the anti-fall safety system made in accordance with the present invention in the case of a frame.
Figure 10:
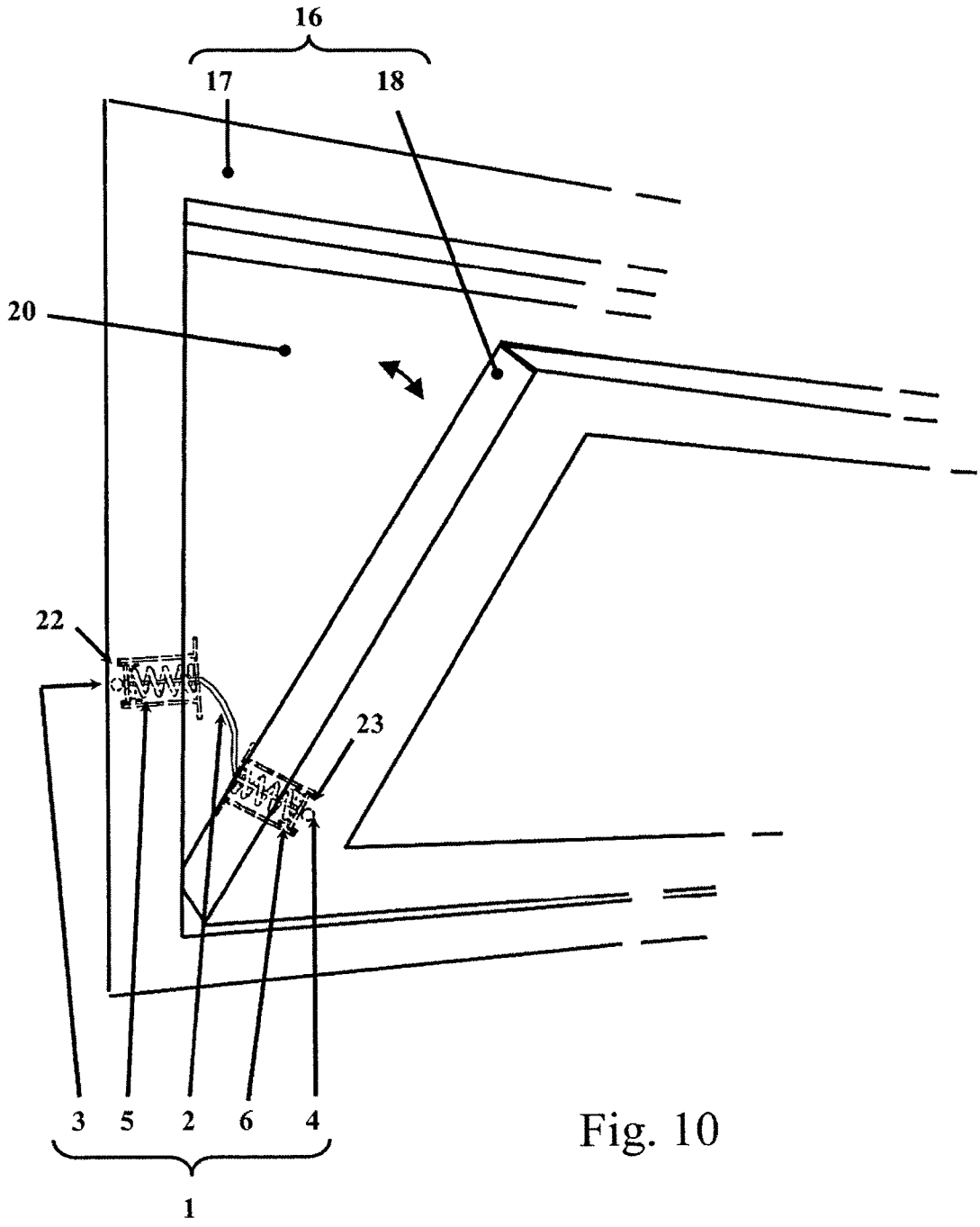
FIG. 10 schematically shows a perspective view depicting the assembly of the anti-fall safety system made in accordance with the present invention in the case of a bottom-hinged frame.
Figure 11:
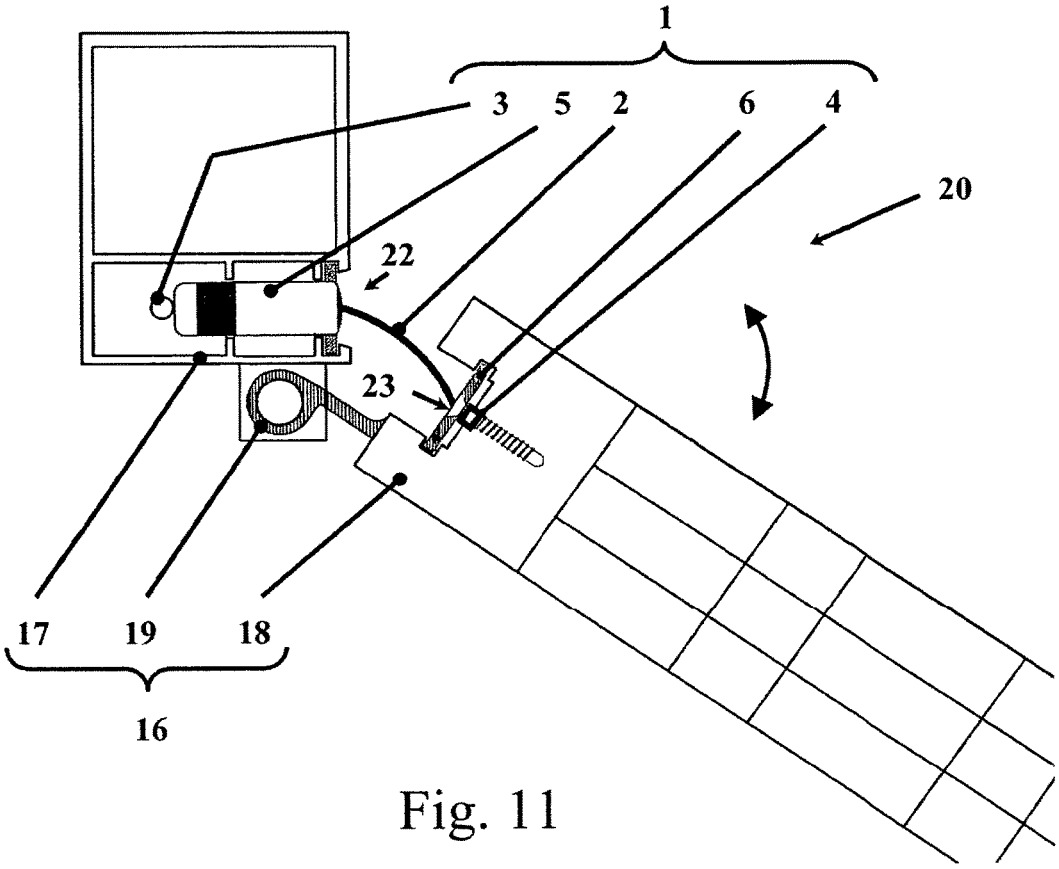
FIG. 11 schematically shows a plan view partially in section depicting the assembly of the anti-fall safety system made in accordance with the present invention in the case of a gate.

In general the safety system (1) according to the invention (FIG. 1, FIG. 2, FIG. 3, FIG. 4, FIG. 5) is intended to prevent the detachment of a first component (18) with respect to a second component (17) of an opening and closing system (16). In the opening and closing system (16), as in the case of casings (FIG. 7, FIG. 8, FIG. 9), wings, doors, main doors, up-and-over doors, windows, vasistas windows (FIG. 10), gates (FIG. 11), etc., a first component (18) and a second component (17) are constrained to each other by means of reciprocal retaining means (19), for example by means of hinges (FIG. 9, FIG. 11). The constraint between the first component (18) and the second component (17) is realized in such a way that the first component (18) is mobile with respect to the second component (17) and in such a way that the first component (18) is mobile between at least two positions of which:

- a closing position in which the first component (18) closes (FIG. 9, FIG. 10, FIG. 11) an access or a space (20);
- an opening position in which said first component (18) leaves said access or space (20) at least partially open.

The safety system (1) comprises (FIG. 1, FIG. 2, FIG. 3, FIG. 6, FIG. 7, FIG. 8, FIG. 9, FIG. 10, FIG. 11) an at least partially flexible elongated means (2). Said elongated means (2) comprises at least one engagement element (3, 4) placed in correspondence of one end of the elongated means (2). For example the elongated means (2) can be a metal cable and the engagement element (3, 4) can be made in form of a sphere or a stop-dowel applied in correspondence of one end of the cable.

The engagement element (3, 4) is intended to engage in correspondence of the first component (18) or the second component (17) at an engagement point (22, 23). Following the engagement by means of the at least one engagement element (3, 4), the elongated means (2) prevents the detachment of the first component (18) with respect to the second component (17) in case of failure, breaking or detachment of one or more of the reciprocal retaining means (19), for example in the form of hinges. As a consequence, during the normal use of the frame the user almost does not notice the presence of the safety system (1) because this will be preferably applied in correspondence of a zone where during the opening the frame there is minimum stroke, such as in proximity to one of the hinges. Should one of the hinges break or come off, the safety system (1) would intervene preventing the complete detachment of the door and preventing it from falling down onto the user.

Obviously one can also provide the presence of several safety systems (1) placed in various positions in order to subdivide the load of the first component (18) in case of detachment.

The anti-fall safety system (1) according to the present invention can comprise (FIG. 1, FIG. 2, FIG. 3) at least one pair of engagement elements (3, 4) placed at opposite ends of the elongated means (2). One engagement element of said pair (4) of engagement elements (3, 4) will be intended to engage in correspondence of the first component (18) at a first engagement point (22) and another possible engagement element of said pair (4) of engagement elements (3, 4) will be intended to engage in correspondence of the second component (17) at a second engagement point (23), following said engagement by means of the engagement elements (3, 4) the elongated means (2) prevents the detachment of the first component (18) with respect to the second component (17) in case of failure, breaking or detachment of one or more of the reciprocal retaining means (19).

In the preferred embodiment of the present invention the at least partially flexible elongated means (2) is a cable, preferably a multi-strand cable, even more preferably a steel multi-strand cable.

Furthermore, it is provided that at least one of the engagement elements (3, 4) engages with the interposition (FIG. 2, FIG. 3) of an elastic means (9) whose compression and/or following release are intended to damp the falling energy due to the detachment of the first component (18) with respect to the second component (17). In practice, in case of detachment, the first component starts falling, but following the tensioning of the cable (2) the falling would be stopped in a very sudden way with the consequence of causing serious damage anyway. By means of the interposition of the elastic means (9), on the other hand, before the falling is stopped, there is the compression of the elastic means (9), which, in this way, contributes to adsorbing at least part of the falling energy, preventing the tensioning of the cable (2) from occurring in a very sudden way. The elastic means (9) can be a spring or an elastic element of rubber, of elastomeric material or of an equivalent at least partially elastic material. The important characteristic is that the elastic means (9) or the material of which it is made is able to adsorb the falling energy transmitted to it by means of the engagement element (3, 4) which is pulled by means of the cable (2).

The reaction load provided by the elastic means (9), both if it is a spring and if it is an elastomeric material, can be adjusted by replacing it according to the weight of the component which is to be supported. For example for a wing of a window one can provide a spring with a smaller reaction load as compared to the case of an access door, which has a significantly greater weight with respect to that of the window.

In an alternative embodiment the damping function may also be performed by the cable itself, which, in this case, could be made in the form of a spring or in the form of a cable of elastomeric material.

The length of the elongated means (2) or cable is at least equal to, preferably greater than the maximum distance between the first engagement point (22) and the second engagement point (23) when the first component (18) is in the opening position. For example in the case of a window, the length of the elongated means (2) is selected in such a way as not to hinder the opening of the wing of the window from the closed position to the completely open position. For this reason the installation of the safety system (1) preferably occurs in correspondence of a position in which the stroke of the door is minimal, for example in correspondence of the hinges, where the distance between the end of the door (18) and of the casing (17) is never too great.

The elongated means (2) is preferably sliding at least in correspondence of or in proximity to one of the engagement elements (3, 4), preferably in correspondence of or in proximity to both engagement elements (3, 4). In this way, thanks to the fact that the cable (2) is sliding, it can be advantageously concealed within the frame (16) so that only the portion corresponding to the angle of opening of the door is partially visible, while the remaining portion of cable (2) can be hidden within an interspace of the frame itself or within an interspace of fixing elements (5, 6) of the safety system (1). The elongated means (2) is preferably sliding over a sliding length which is greater than or equal to the maximum distance between the first engagement point (22) and the second engagement point (23) when the first component (18) is in the opening position.

It can be provided that at least one portion of the elongated means (2) is sliding within an interspace or a hiding seat obtained within profiled elements constituting the first component (18) or the second component (17). In this way the elongated means (2) is advantageously hidden and does not interfere with the operations of opening and closing of the frame.

As observed, the safety system (1) can comprise fixing elements (5, 6) which facilitate installation also on existing casings, wings, doors, main doors, up-and-over doors, windows, vasistas windows, gates. For example, it is possible (FIG. 1, FIG. 2, FIG. 3) to use a first fixing element (5) in a solution in which at least one of the engagement elements (3, 4) engages in correspondence of said first fixing element (5) which is adapted to be applied in correspondence of the first engagement point (22) or in correspondence of the second engagement point (23). Said first fixing element (5) can also constitute the element within which one can mount or house the elastic means (9), which will be, therefore, advantageously housed within a housing element (7) of the first fixing element (5). In this case the elongated means, for example in the form of a cable (2) penetrates (FIG. 1, FIG. 2, FIG. 3, FIG. 4) into a body of the housing element (7) by means of a first hole (11), it crosses the housing (7) passing internally to the elastic means (9) and exits the housing element (7) through a second hole (10) which is obtained on a closing element (8) of the housing element (7). The extraction of the cable (2) with respect to the housing element is prevented by the application of one of the engagement elements (3, 4), which is intended to engage on the closing element (8) of the housing element (7). In this solution the closing element (8) is sliding within the body of the housing element (7), the sliding of said closing element (8) in a first direction causing (FIG. 3) the compression of the elastic means (9) and the sliding of the closing element (8) in a second direction opposite to the first direction causing (FIG. 2) the release of the compression of the elastic means (9) with a damping action of the falling energy due to the detachment of the first component (18) with respect to the second component (17).

One can also provide a solution in which:

- a first engagement element (3) engages in correspondence of the first fixing element (5) which is adapted to be applied in correspondence of the first engagement point (22);
- a second engagement element (4) engages in correspondence of a second fixing element (6) which is adapted to be applied in correspondence of the second engagement point (23).

The second fixing element (6) can be shaped (FIG. 5) in the form of a plate provided with a passage (13) which is intended to allow the passage of the elongated means (2) but shaped with a size of the passage (13) such as to stop the passage of the engagement element (3, 4), which engages on said second fixing element (6) in correspondence of the passage (13) obtained on the body (12) of the second fixing element (6) itself. Obviously, while the passage (13) is represented in the form of a slit that may facilitate the passage of the cable after the assembly of the second fixing element (6), the passage (13) can also be shaped as a hole, in which case the corresponding engagement element which is intended to engage with it can be a stop-dowel that can be fixed on the cable itself after the cable has been made to pass in the passage (13) in the form of a hole, the stop-dowel having a dimension in section greater than that of the passage (13) in the form of a hole in order to prevent its extraction.

The compression of the elastic means (9) can occur:

according to a direction essentially corresponding (FIG. 1, FIG. 6, FIG. 9, FIG. 10, FIG. 11) to the direction of displacement between the first component (18) and said second component (17) following the detachment of the first component (18) with respect to the second component (17);

according to a direction essentially orthogonal (FIG. 7, FIG. 8) with respect to the direction of displacement between the first component (18) and the second component (17) following the detachment of the first component (18) with respect to the second component (17).

Thanks to the second solution it is possible to obtain a more compact and thinner anti-fall safety system (1) which can be applied more easily in existing frames or in frames that are difficult to be worked in order to obtain some internal insertion seats, as in the case of wooden frames. In these solutions one can provide the presence (FIG. 8) of at least one guiding means (21), which is intended to guide and facilitate the sliding of the elongated means (2). For example the guiding means (21) can be a rotating roller, possibly provided with a sliding and containment groove for the elongated means (2) in the form of a cable. As an alternative, in order to increase friction and energy damping without affecting sliding facility too much, the guiding means (21) can be an arched sliding guide joining two essentially rectilinear portions of which a first rectilinear portion is a rectilinear portion which is oriented according to a direction corresponding to the direction of compression of the elastic means (9) and a second rectilinear portion is a rectilinear portion which is oriented according to a direction of displacement between the first component (18) and the second component (17) following the detachment of the first component (18) with respect to the second component (17). For example in this case the guiding means (21) can be a metal pipe bent at a right angle within which the cable (2) is slid and which allows to align the movement of the cable on the one side with the preferred direction of compression of the elastic means (9) and on the opposite side with the preferred direction of displacement of the door with respect to the framework of the fixed part of the frame. The engagement element (3, 4) can comprise (FIG. 1) a sphere having a diameter greater than the dimension in section of the elongated means (2) or (FIG. 1) it can comprise a stop-dowel which is adapted to be applied on the elongated means (2) itself wherein said stop-dowel has a dimension in section greater than the dimension in section of the elongated means (2), or a swelling of the elongated means (2) or a swelled portion of the elongated means (2).

The present invention also relates to (FIG. 7, FIG. 8, FIG. 9, FIG. 10, FIG. 11) an opening and closing system (16) which is provided with at least one first component (18) and one second component (17), such as a casing or fixed framework (17) and a door or mobile framework (18), wherein the first component (18) and the second component (17) are constrained to each other by means of reciprocal retaining means (19), such as a hinge, in such a way that the first component (18) is mobile with respect to the second component (17). The first component (18) of the opening and closing system (16) is mobile between at least two positions of which a closing position in which the first component (18) closes an access or a space (20) and an opening position in which the first component (18) leaves said access or space (20) at least partially open. The opening and closing system (16) according to the invention comprises at least one anti-fall safety system (1) made in compliance with the previous description, said anti-fall safety system (1) being intended to prevent the detachment of the first component (18) with respect to the second component (17) in case of failure, breaking or detachment of one or more of the reciprocal retaining means (19).

For example the opening and closing system (16) can be selected from the group consisting of door or window casings, wings, doors, main doors, up-and-over doors, windows, vasistas windows, gates.

Furthermore, in particular, the present invention also relates to (FIG. 9, FIG. 10) a frame (16) which is provided with at least one door (18) and one casing (17), wherein the door (18) and the casing (17) are constrained to each other by means of hardware elements (19) in such a way that the door (18) is mobile with respect to the casing (17), wherein the door (18) is mobile between at least two positions of which a closing position in which the door (18) closes an access or a space (20) delimited by the casing (17) and an opening position in which the door (18) leaves said access or space (20) at least partially open, the frame (16) comprising at least one anti-fall safety system (1) made in compliance with the previous description, said anti-fall safety system (1) being intended to prevent the detachment of the door (18) with respect to the casing (17) in case of failure, breaking or detachment of one or more of the hardware elements (19).

The description of the present invention has been made with reference to the enclosed figures in a preferred embodiment, but it is evident that many possible changes, modifications and variations will be immediately clear to those skilled in the art in the light of the previous description. Thus, it must be underlined that the invention is not limited to the previous description, but it includes all the changes, modifications and variations in accordance with the appended claims.

Nomenclature Used with reference to the identification numbers in the enclosed figures, the following nomenclature has been used:

1. Safety system
2. Cable or elongated means
3. Second engagement element
4. First engagement element
5. First fixing element
6. Second fixing element
7. Housing element
8. Closing element
9. Elastic means
10. Second hole
11. First hole
12. Body
13. Passage
14. Third hole
15. Fourth hole
16. Frame or opening and closing system
17. Casing or fixed framework or second component
18. Door or mobile framework or first component
19. Hinge or hardware element or reciprocal retaining means

20. Access or space
21. Guiding means
22. First engagement point
23. Second engagement point

The invention claimed is:

1. An anti-fall safety system comprising:

a first component of an opening and closing system;

a second component of the opening and closing system, the anti-fall safety system adapted to prevent detachment of said first component with respect to said second component, said first component being joined to said second component by a reciprocal retainer such that said first component is movable with respect to said second component, said first component being movable between a first position in which said first component closes an access or space and a second position in which said first component at least partially opens the access or space;

at least one partially flexible elongated member having at least one engagement element positioned at one end of said at least one partially flexible elongated member, said at least one engagement element engageable at at least one engagement point with one of said first component or said second component, wherein the engagement of said at least one engagement element of said at least one partially flexible elongated member prevents a displacement or detachment beyond a predetermined maximum limit of said first component with respect to said second component in an event of a failure, a breaking or a detachment of said reciprocal retainer, said at least one engagement element having an elastic member that is adapted to dampen energy resulting from a detachment between said first component and said second component;

a first fixing element engaging said at least one engagement element, said first fixing element adapted to be applied to the at least one engagement point, said elastic member being housed within a housing of said first fixing element, said at least one partially flexible elongated member being a cable that extends into said housing through a first hole, said cable crossing said housing and passing through said elastic member and exits said housing through a second hole, said second hole formed on a closing element of said housing, said at least one engagement element engaging said closing element so as to prevent extraction of said cable with respect to said housing, said at least one engagement element adapted to engage said closing element of said housing, said closing element being slidable within said housing, said closing element being slidable in a first direction so as to cause a compression of said elastic member and in a second direction opposite to the first direction so as to release compression of said elastic element.

2. The anti-fall safety system of claim 1, said at least one engagement element comprising a pair of engagement elements that are placed at opposite ends of said at least one partially flexible elongated member, the at least one engagement point comprising a first engagement point and a second engagement point, one of the pair of engagement elements engaging said first component at the first engagement point, another of the pair of engagement elements engaging at the second engagement point, said at least one partially flexible elongated member adapted to prevent the detachment or displacement beyond the predetermined maximum limit of said first component with respect to said second component.

3. The anti-fall safety system of claim 1, said cable being a multi-strand cable.

4. The anti-fall safety system of claim 1, said elastic member being a spring.

5. The anti-fall safety system of claim 1, said elastic member being formed of a rubber or an elastomeric material.

6. The anti-fall safety system of claim 2, wherein a length of said at least one partially flexible elongated member is no less than a maximum distance between said first and second engagement points when said first component is in the second position.

7. The anti-fall safety system of claim 1, wherein said at least one partially flexible elongated member is slidable in correspondence to or in proximity of said at least one engagement element.

8. The anti-fall safety system of claim 1, wherein at least a portion of said at least one partially flexible elongated member is slidable in an interspace within profile elements of one of said first component and said second component.

9. The anti-fall safety system of claim 7, the at least one engagement point comprising a first engagement point and a second engagement point, wherein said at least one partially flexible elongated member is slidable along a sliding length no less than a maximum distance between said first and second engagement points when said first component is in the second position.

10. The anti-fall safety system of claim 2, wherein said first engagement element engages said first fixing element and said second engagement element engages a second fixing element, said second fixing element having a plate shape with a passage having a size that allows said at least one partially flexible elongated member to pass therethrough but prevents a passing of said engagement element therethrough.

11. The anti-fall safety system of claim 1, wherein the compression of said elastic member is along a direction corresponding to a direction of displacement between said first component and said second component when said first component is detached from said second component.

12. The anti-fall safety system of claim 1, wherein the compression of said elastic member is along a direction orthogonal to a direction of displacement between said first component and said second component when said first component is detached from said second component.

13. The anti-fall safety system of claim 1, further comprising:

a guide cooperative with said at least one partially flexible elongated member and adapted to guide and facilitate sliding of said elongated member.

14. The anti-fall safety system of claim 13, wherein said guide is a rotating collar having a sliding and containment groove that receives said at least one partially flexible elongated member.

15. The anti-fall safety system of claim 13, wherein said guide is an arched sliding guide joining a pair of essentially rectilinear portions, one of the pair of rectilinear portions being oriented along a direction corresponding to a direction of compression of said elastic member, another of the pair of rectilinear portions being oriented in a direction of displacement between said first component and said second component when first component is detached from said second component.

16. The anti-fall safety system of claim 1, wherein said at least one engagement element is a sphere having a diameter greater than a cross-sectional diameter of said at least one partially flexible elongated member.

17. The anti-fall safety system of claim 13, wherein said at least one engagement element comprises a stop-dowel applied on said at least one partially flexible elongated member, said stop-dowel having a cross-sectional dimension that is greater than a cross-sectional dimension of said at least one partially flexible elongated member.

18. An opening or closing system having the anti-fall safety system of claim 1.

19. The opening or closing system of claim 18, wherein the opening or closing system is selected from the group consisting of window casings, door casings, wings, doors, windows, and gates.

20. The opening or closing system of claim 18, the first component being a door and the second component being a casing, the opening and closing system further comprising:

a frame having the door and the casing connected to each other by hardware elements such that the door is mobile with respect to the casing, the door being movable between a closing position in which the door closes the access or the space and an open position that at least partially opens the access or space, the anti-fall safety system preventing detachment or displacement beyond a predetermined limit of the door with respect to the casing in an event of a failure, a break, or a detachment of at least one of the hardware elements.

* * * * *